US007415919B2

(12) United States Patent
Link et al.

(10) Patent No.: US 7,415,919 B2
(45) Date of Patent: Aug. 26, 2008

(54) SERIES HYDRAULIC CIRCUIT FOR CONTROLLING OPERATION OF MULTIPLE CUTTING DECKS OF A TRACTOR

(75) Inventors: Todd Allen Link, Apex, NC (US); Neil Vincent Harber, Benson, NC (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/982,914

(22) Filed: Oct. 19, 2001

(65) Prior Publication Data

US 2003/0075040 A1 Apr. 24, 2003

(51) Int. Cl.
*F15B 11/20* (2006.01)

(52) U.S. Cl. ..... 91/520; 56/10.9

(58) Field of Classification Search ..... 91/520, 91/522, 461; 56/10.8, 10.9, 11.9
See application file for complete search history.

(56) References Cited

U.S. PATENT DOCUMENTS 3,348,624 A * 10/1967 Just et al. ..... 60/484 X
3,631,930 A * 1/1972 Peterson ..... 172/821
3,713,296 A * 1/1973 Black ..... 91/520 X
3,987,622 A 10/1976 Johnson
3,991,832 A * 11/1976 Cooper ..... 91/520 X
4,206,580 A * 6/1980 Truax et al. ..... 56/11.9
4,276,896 A * 7/1981 Hunck et al. ..... 91/520 X
4,526,085 A * 7/1985 Morizur et al. ..... 91/520 X

FOREIGN PATENT DOCUMENTS

| | | |
|---|---|---|
| DE | 39 01 349 A1 | 7/1990 |
| DE | 195 26 909 A1 | 1/1997 |
| JP | 59 185234 | 10/1984 |
| JP | 60 092187 | 5/1985 |
| JP | 63 247430 | 10/1988 |

* cited by examiner

*Primary Examiner*—F. Daniel Lopez

(57) ABSTRACT

A series hydraulic circuit for permitting motorized operation and independent control of a plurality of cutting decks of a mower. The circuit allows separate operation of one of the decks while enabling operation of one or more of the other decks associated with the mower to simultaneously occur.

4 Claims, 2 Drawing Sheets

SERIES HYDRAULIC CIRCUIT FOR CONTROLLING OPERATION OF MULTIPLE CUTTING DECKS OF A TRACTOR

FIELD OF THE INVENTION

This invention relates generally to an electro-hydraulic control valve and more specifically, to the use of such a control valve in a series hydraulic circuit to simultaneously and separately control the operation of multiple cutting decks of a mowing tractor.

BACKGROUND OF THE INVENTION

It is known to provide a hydraulic circuit to conduct the flow of hydraulic fluid so as to allow a motor of a vehicle, such as a mower, to be operated. Typically, these circuits are provided with a series of valves and switches to direct the flow of that liquid, whereby pressure associated with that flow to that motor permits its device, a blade as in the case of a mowing tractor, to move.

In providing these circuits, at least two designs have been used to accomplish the above. A first design has included providing a separate circuit for each of the motors, and thus the devices whose motion they control. A second design has included providing a single circuit and connecting each of the motors in series whereby flow to a particular motor can be accomplished through control of an associated valve manifold or collection of valves within the circuit.

With each of the above designs, disadvantages exist. In the case of providing a separate circuit for each of the separate motors, each circuit would require its own pump and control valve whereby the cost of doing so disfavors providing an economical product to the consumer. In the case of providing a circuit having each of the motors connected in series, efficiency, or the ratio of the work output to the work input across a system, is often decreased. This decreased efficiency results from drops in pressure across the valves which control the direction and function of flow and pressure through the circuit. These valves exist to regulate, as stated above, the pressure across the circuit when it is necessary to control the flow of hydraulic fluid to a first motor while preventing flow to one or more of a series of motors when it is desired to only operate one or a combination thereof. As fluid passes over these valves, the system experiences a drop in fluid pressure causing the system to be less efficient than it could otherwise be. Additionally, cost disadvantages also exist in this design due to the provision of these control valves.

Thus, it would be beneficial to provide a circuit which could allow for the control of multiple motors in a series circuit while doing so with low parasitic loss, or the pressure drop across the manifold, and a minimal number of valves within the manifold as a result of how fluid is directed to a particular motor.

SUMMARY OF THE INVENTION

Accordingly, there is provided a hydraulic circuit which allows for the direction of hydraulic flow to a combination of motors and which includes a minimum number of parts to control that flow while preventing its unintended redirection.

In directing flow among at least three motors, the circuit allows for the operation of a front or first motor by itself. Additionally, since it is designed to align the motors in series, the circuit permits the operation of the front motor alone, the front and a left or second motor, the front motor and a right or third motor, or alternatively, operation of all three motors and their attached devices simultaneously.

To allow fluid to be communicated to at least the front motor without that flow being permitted to enter the flow path of the left and right motors, the circuit provides a switchable connection for directing the exit flow of the front motor through the manifold, bypassing the left and right motor. In other words, the flow path along which fluid from the front motor is communicated through the manifold is substantially prevented from entering the hydraulic lines servicing either the left or right motors. Further, the flow supplying the second or third motor, when operating separately, is substantially prevented from entering the hydraulic lines servicing the other of the second and third motors. Finally, when each of the second and third motors are operating, the supply of fluid from the first motor is delivered, initially, to a second motor whose exit flow is delivered to a third motor whose exit flow is then directed to an outlet.

Accordingly, the circuit is enabled to accomplish the efficient flow and individual operation of three motors, or a combination thereof, in a cost effective manner due to unneeded flow controls.

DESCRIPTION OF THE PREFERRED EMBODIMENT

Figure 1:
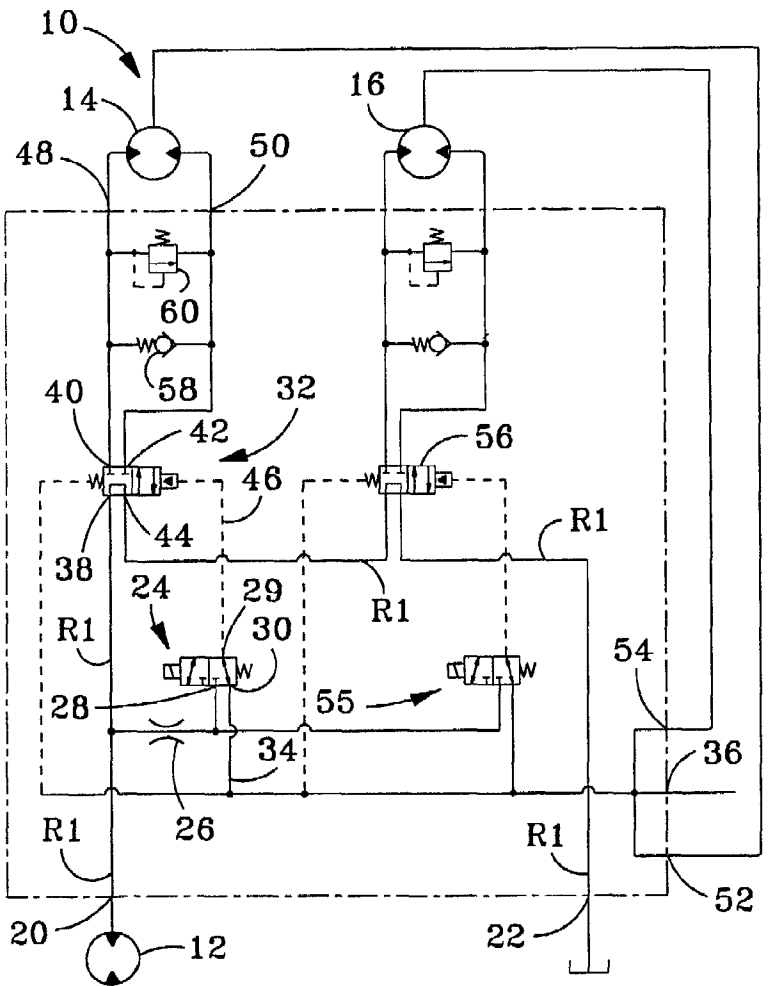
FIG. 1 is a schematic of the hydraulic circuit according to the instant invention whereby only the front motor is operating.

Looking to FIG. 1, there is shown a hydraulic circuit 10 for controlling flow of hydraulic liquid to one or a combination of each of three motors 12, 14, 16 whereby each of these motors moves a device (not shown), such as a blade of the lawn and garden tractor, for its intended purpose. Each of the front, left and right motors 12, 14, 16, respectively, are designated in the diagram of FIG. 1. The circuit 10 permits operation of the front motor alone or in combination with the right and/or left motor by controlling the flow and associated pressurization of the flow in each of the hydraulic lines which services their respective motor.

Figure 2:
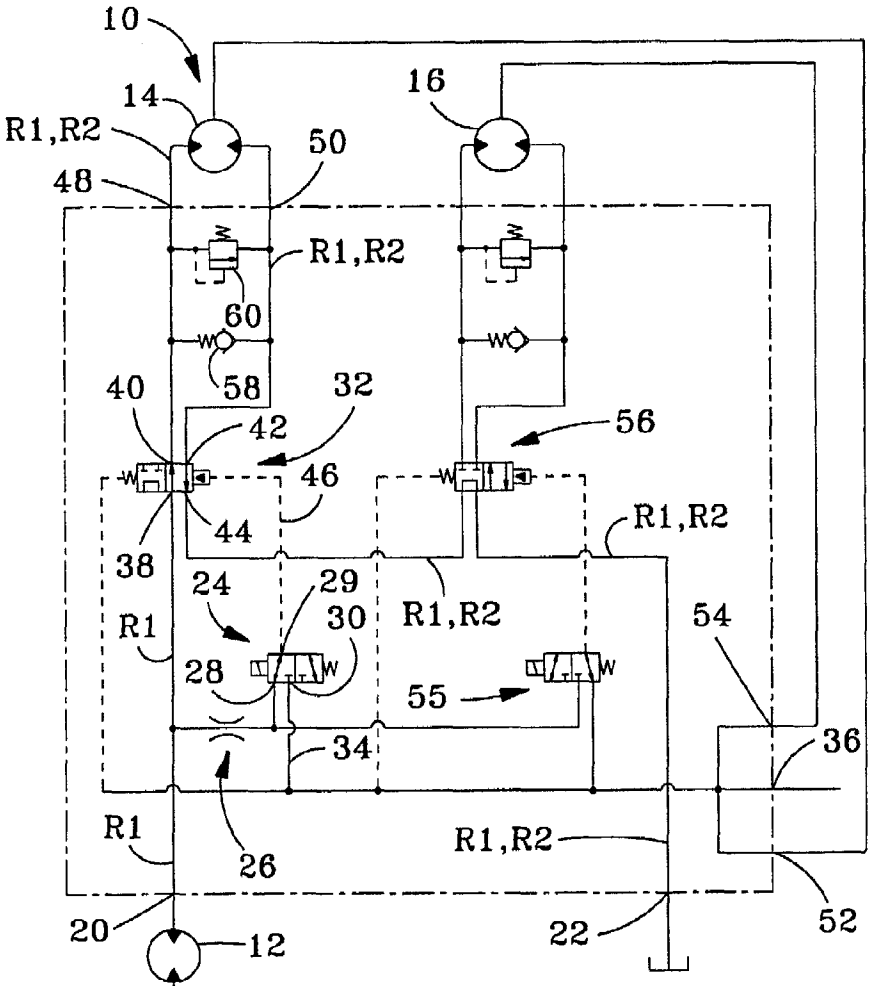
FIG. 2 is a schematic of the circuit showing the operation of both the front and left motors.
Figure 3:
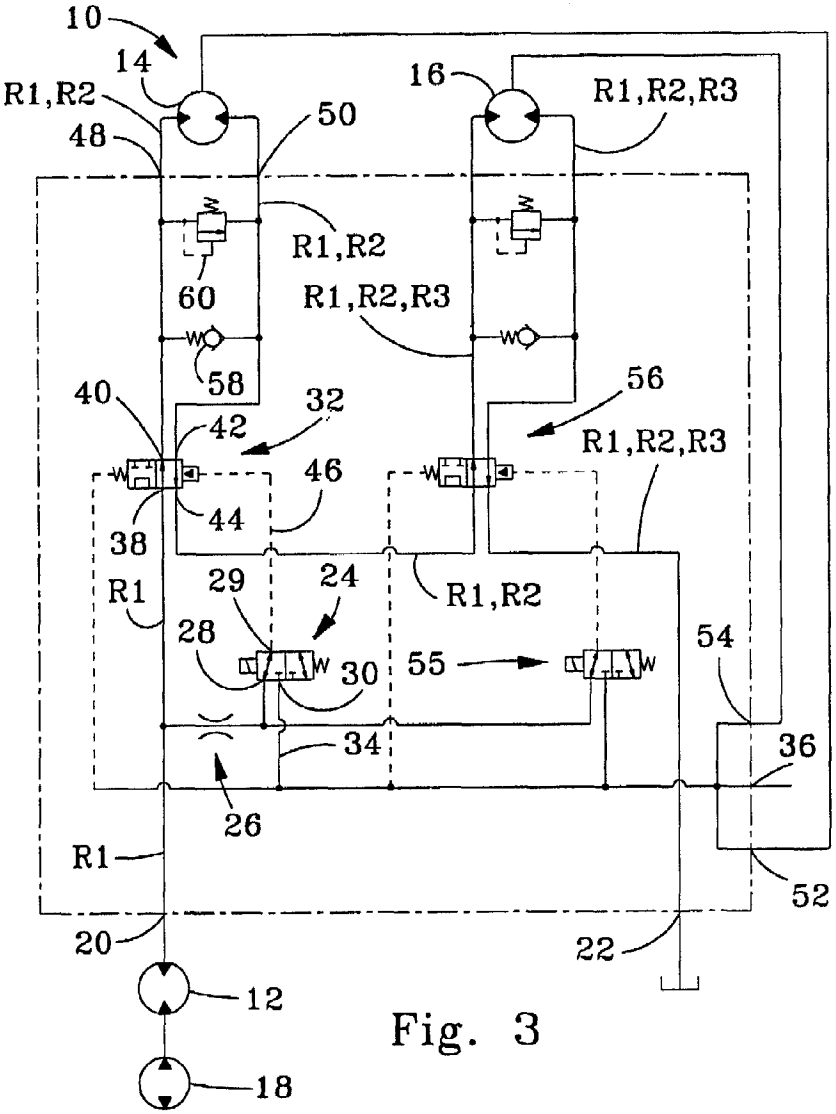
FIG. 3 is a schematic of the circuit showing the operation of the front, left and right motors.

As shown in FIGS. 1-3, the circuit 10 permits the flow of hydraulic liquid in each of three patterns R1; R1, R2 and R1, R2, R3. As shown in FIG. 1, R1 represents the flow of fluid which supplies the front motor 12 and which is then circulated through the circuit 10. As is shown, a hydraulic pump 18 is provided as part of the vehicle engine (not shown). Upon activation of a pressurized control switch (not shown), the pump 18 will supply fluid to the front motor 12 and then through an inlet 20 whereby it is then further distributed through the circuit 10 along the path R1, as shown in FIG. 1, until it exits through an outlet 22.

Looking to FIG. 2, the flow of the hydraulic fluid permitting operation of the front and left motors 12 and 14, respectively, is shown and represented as R1, R2. Likewise, as in the case of FIG. 1, fluid is supplied by the pump 18 through both the front motor 12 and the inlet 20. This flow is R1. However, when it is intended that the left motor 14 be made operational, an operator will lower the left mower deck (not shown) into its operating position via a control lever (not shown), which is located on the tractor operator's panel, to cause the flow R1, R2.

Upon the operator lowering the left mower deck into position, a first switching means in the form of a two position, three way solenoid operated directional control valve 24, will become energized by an electric current, causing the valve to shift from a first or "closed" position shown in FIG. 1 to a second or "open" position shown in FIG. 2. This change to the "open" position allows flow to be communicated between the ports 28 and 30 of the valve 24. After flowing through the valve 24, hydraulic fluid is passed onward, as a pilot signal, to shift an externally pilot operated two position, four way directional control valve 32 or first fluid transfer means (discussed below).

The directional control valve 32, prior to the energizing of the solenoid valve 24, is closed, as is shown in FIG. 1, and is opened as shown in FIG. 2 by pressure from flow which has passed through the solenoid valve 24, as has been previously stated. As shown in FIG. 1, the directional valve 32 has four ports 38, 40, 42 and 44 therein whereby fluid can be passed through the port 38 to the port 44 whereby the ports 40 and 42 are closed to the motor 14. Referring to FIG. 2, it is seen that upon pressurization by fluid traveling along a line 46 as a result of energizing the solenoid valve 24, the directional valve 32 and its ports 38 to 40 and 42 to 44 are opened so as to allow the main flow of fluid R1 supplying the front motor 12 to flow vertically upward therethrough and along a path R1, R2 through an exit port 48 which supplies and permits fluid to be passed through the left motor 14. After passing through the motor 14, the fluid re-enters the path R1, R2 through the port 50 where it then continues towards the outlet 22. Fluid which escapes the motor 14 and which does not flow along the path R1, R2 is routed to a drain port 52 which is combined with the drain flow of the directional valve 32 and is then returned to the tank 36. A similar directional flow can be conducted in a corresponding manner when it is desired that the right motor 16 be made operational.

When operability of the front and right motors 12, 16 is desired, a second switching means in the form of a solenoid valve 55 will become energized in a fashion similar to that occurring with the valve 24. The flow R1 will bypass the directional valve 32 in its first or "closed" position whereby the fluid flows and is passed through a second fluid transfer means or directional control valve 56 and then through the right motor 16. As such, a flow pattern similar to that of R1, R2 may be used to symbolize the supply and directional movement of fluid directed to the right motor 16. Similarly, a drain 54 is provided to receive excess drainage from the right motor 16.

When it is desired that each of the front, left and right motors 12, 14 and 16 be operated together so as to turn the devices they operate, each of the solenoid valves 24, 55 will be separately shifted whereby this change in position can be seen when looking at FIGS. 1 and 3. With this shifting, the respective directional control valves 32 and 56 will move to their second or open position so as to permit their ports to be opened and allow the flow of fluid therethrough.

Accordingly, the left and right motors 14 and 16 will be made operational as hydraulic fluid is then able to be delivered to them. As can be seen in FIG. 3, actuation of both solenoid valves 24 and 55 associated with the left and right motors 14 and 16, respectively, establishes a flow path R1, R2, R3. The flow of hydraulic fluid exiting the left motor 14 may do so only in one direction which is directed towards the outlet 22. Consequently, flow is permitted to be directed only in a first entry and exit direction with respect to supplying the right motor 16; therefore, instances in which the flow R1 , R2 (supplied to the right motor 16) could re-enter the supply lines of the left motor 14, with a directional flow which is different than that which has been described above, are substantially prevented.

As also shown in FIGS. 1-3, flow patterns R1, R2 and R1, R2, R3 each include a relief such as the valve 60 therealong, which is provided to release excess fluid in the circuit when a sudden increase in pressure driving the flow thereof is experienced. Such an increase in pressure may occur, as in the case of a rotating mower blade, when an object impacts the blade causing it to suddenly slow or stop so as to affect the work done by its respective motor. For example, the fluid pressure along R1, R2 may be higher at the port 48 than that at the port 50 when an object impacts the blade. Because the front motor 12 is operating upstream of the motor 14 in the series circuit and possesses inertia, or a tendency to move the fluid therein due to the rotation of its blade, obstructions affecting the left motor 14 will cause the inertia of the motor 12 to yield a sudden increase in pressure in R1, R2. As the flow R1, R2 is directed through the circuit, this pressure will be released through the relief valve 60 if it increases in an amount greater than that of the relief valve setting so as to bypass the obstructed motor 14 and preventing damage to its components. This component protection system can also be seen in the R1, R2, R3 flow path. Where an obstruction affects the right motor 16, the fluid will resume traveling along the designated pattern R1 , R2, R3 towards the outlet 22, bypassing the right motor 16.

During operation, if it is desired to disengage the left motor 14, the operator will raise the left mower deck so as to cut the electrical signal to its associated solenoid valve 24. In turn, the solenoid valve 24 is shifted to its first or closed position creating a flow path from the port 29 to the port 30, as shown in FIG. 1, so as to connect it to the tank 36 along a line 34. This allows the directional control valve 32 to return to its first or closed position due to a spring force acting on it to connect the ports 38 to 44 and close the ports 40 and 42. With the left motor 14 still possessing inertia due to the rotation of its blade, the inertia will try to move the trapped fluid from the port 48 to the port 50. Ordinarily, the momentum of the blade must be dissipated in a set time and is accomplished by the spring loaded check valve 58. Since the pressure is lower on the left side of the motor 14 than on the right side thereof, the valve 58 will allow flow to pass through, from right to left. The flow is then returned to the left motor 14 through the port 48. This path is repeated until the motor 14 is brought to a stop. A similar system can be seen in the right motor circuit.

Figure 4:
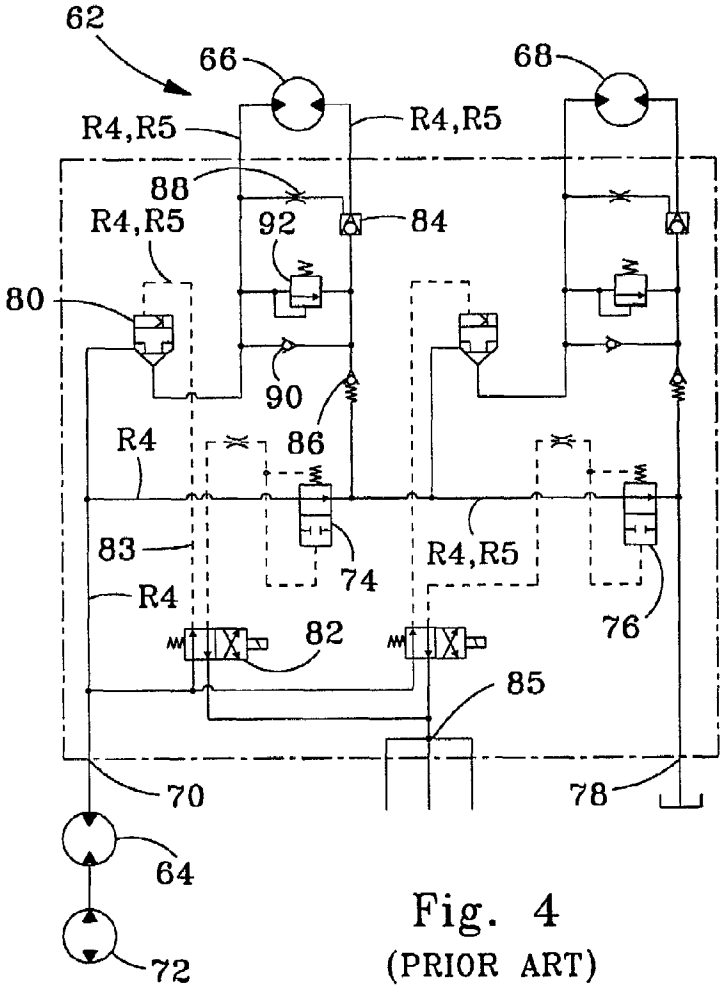
Fig. 4 (PRIOR ART)
FIG. 4 is a schematic of a series hydraulic circuit of the prior art whereby only the front motor is operating.

Looking to FIG. 4, there is shown a hydraulic circuit 62 of the prior art whereby each of the front, left and right motors 64, 66 and 68, respectively, are connected in series. Although the goal of permitting the front motor 64 to be operated in combination with either of the left or right motors 66, 68 or both, can be accomplished with this circuit 62, the routing of flow through the circuit 62 requires a number of valves which are not present in the instant invention. As can be seen, fluid transmitted through the inlet 70 by a pump 72 will service a front motor 64 and be communicated along the path R4. Upon entry into the path R4, the hydraulic fluid will pass through the ports of a first logic control valve 74 which acts to pass flow to the also open ports of a second logic control valve 76 and towards the outlet 78.

In the case in which it is desired to operate the front and left motors 64 and 66, flow will be directed to a logic control valve 80 and then along a path R4, R5 after a solenoid valve 82 has been energized by the operator having switched the control for the left motor 66 located on the vehicle operator's panel.

The shifting of the solenoid valve 82 allows a pilot signal from R4, in the form of pressure, to shift the logic valve 74 to its closed position while connecting the pilot line 83 from the logic valve 80 to the tank 85 allowing it to open a flow path for R4 to the motor 66. Along this path, the flow R4, R5 will encounter a pilot check valve 84 used for braking the motor upon shut down as well as a check valve 86 used to regulate flow only in the downward direction. Thereafter, the flow will continue to exit the system along the path designated R4, R5. With the flow just described being similar in nature for that required to obtain operation of the right motor 68, only the operation of and the flow designated R4, R5 servicing the left motor 66 has been described.

As can be seen in FIG. 4, should operation of the right motor 68 be desired, it is possible for its associated flow to be diverted backward towards the check valve 86. Consequently, due to the routing of the flow R4,R5, the check valve 86 is required to prevent the redirection of that flow R4,R5 towards the left motor 66. In providing this valve 86, the flow R4,R5 crosses it and will experience a further drop in pressure as a result of its placement. This drop in pressure, as discussed previously, causes a reduction in the amount of work done by the system so as to also cause a related drop in the efficiency of the circuit overall.

Additionally, with respect to instances in which the blade or other device powered by the left motor 66 is operating, a loop beginning with the pilot check valve 84 is created to restrict the flow which exits across the motor 66 when the circuit is turned off so as to slow the motor 66 and subsequently the blade thereof. The left motor 66 is taken out of, or not serviced by, the flow path R4,R5 by cutting power to its associated solenoid valve 82 so as to shift the pilot signal and redirect the flow R4 to cross the logic valve 74, the entire process closing off the logic valve 80 and the flow R4,R5 used to feed the motor 66. As described above, momentum of the motor 66 must be dissipated in order to stop motion of the blade. Once pressure is reduced on the inlet side of the motor 66 at the left side thereof, the pilot check valve 84 is allowed to close, restricting the flow from the motor 66 and returning it in a closed loop fashion, as discussed in relation to the motor 14, to the motor 66 across the check valve 90 until the motor has been stopped. During operation, the system experiences undesirable pressure drop(s) as a result of directing the flow R4, R5 through the valves 84 and 86 and causes an associated loss in efficiency across the circuit.

Thus, in contrast to the circuit 62 just described and shown in FIG. 4, there is provided a hydraulic circuit 10 which connects each of three motors 12, 14 and 16 in series while eliminating restrictive valves within the operating flow path to allow for increased efficiency across the circuit 10. This increase in efficiency is permitted by eliminating valves such as the check valve 86. This increase is accomplished since the flows R1 and R1, R2 are routed into and out of their associated fluid transfer means, thereby achieving isolation of the left and/or right motor(s) so as to block flow not associated with either of those motors from inadvertently re-entering it.

Having described the preferred embodiment, it will become apparent that various modifications can be made without departing from the scope of the invention as defined in the accompanying claims.

We claim:

1. A hydraulic system connecting first, second and third hydraulic motors in series, each motor rotating a separate mower blade under first, second and third mower decks, comprising:

a first solenoid-operated directional control valve and a second solenoid-operated directional control valve, which are connected in parallel to an inlet line from the first hydraulic motor, a first pilot-operated directional control valve and a second pilot-operated directional control valve, which are connected in series to the inlet line from the first hydraulic motor;

the first solenoid-operated directional control valve energized by lowering the second mower deck into an operating position to provide an electrical signal to the first solenoid-operated directional control valve which provides a first pilot signal to the first pilot-operated directional control valve that in response to the first pilot signal directs a flow of hydraulic fluid passing through the first hydraulic motor to pass through the second hydraulic motor without directing the flow through any other restrictive valves; the first solenoid-operated directional control valve being de-energized by raising the second mower deck into a non-operating position to cut the electrical signal to the first solenoid-operated directional control valve to end the pilot signal to the first pilot-operated directional control valve to direct the flow of hydraulic fluid passing through the first hydraulic motor to bypass the second hydraulic motor; and the second solenoid-operated directional control valve energized by lowering the third mower deck into an operating position to provide an electrical signal to the second solenoid-operated directional control valve which provides a second pilot signal to the second pilot-operated directional control valve that in response to the second pilot signal directs a flow of hydraulic fluid passing through the first hydraulic motor to pass through the third hydraulic motor without directing the flow through any other restrictive valves; the second solenoid-operated directional control valve being de-energized by raising the third mower deck into a non-operating position to cut the electrical signal to the second solenoid-operated directional control valve to end the pilot signal to the second pilot-operated directional control valve to direct the flow of hydraulic fluid passing through the first hydraulic motor to bypass the third hydraulic motor.

2. The hydraulic system of claim 1 wherein lowering both of the second and third mower decks into their operating positions causes the first and second solenoid-operated directional control valves to provide pilot signals to the first and second pilot-operated directional control valves that in response to the pilot signals direct the hydraulic fluid passing through the first hydraulic motor to pass through the second and third hydraulic motors in series without directing the flow through any other restrictive valves.

3. A hydraulic system to provide hydraulic flow to first, second and third hydraulic motors located on first, second and third mower decks, the second and third mower decks movable between operating and non-operating positions, comprising:

a pair of solenoid-operated control valves connected to an input from the first hydraulic motor, each solenoid-operated control valve associated with one of the second and third motors and providing a pilot signal if the mower deck on which the motor is located is moved to the operating position; and a pair of pilot operated control valves connected to the input from the first hydraulic motor and operatively connected to the solenoid-operated control valves; each pilot operated control valve directing hydraulic flow passing through the first motor to pass through one of the second and third hydraulic motors in the presence of a pilot signal associated with that motor without directing the hydraulic flow through any other restrictive valves, and preventing hydraulic flow from passing through the second or third hydraulic motor in the absence of the pilot signal; the pilot operated control valves directing hydraulic flow passing through the first motor to pass through the second and third hydraulic motors in series in the presence of a pair of pilot signals without directing the hydraulic flow through any other restrictive valves.

4. The hydraulic system of claim 3 wherein the first hydraulic motor is not associated with a solenoid-operated control valve.

* * * * *